US006920647B2

(12) United States Patent
Ulert et al.

(10) Patent No.: US 6,920,647 B2
(45) Date of Patent: Jul. 26, 2005

(54) HIP PROTECTOR

(76) Inventors: Izaak A. Ulert, 2929 Post Oak Blvd., #402, Houston, TX (US) 77056; Heinrich Lang, 43 Winter Wheat Pl., The Woodlands, TX (US) 77381

( * ) Notice: Subject to any disclaimer, the term of this patent is extended or adjusted under 35 U.S.C. 154(b) by 827 days.

(21) Appl. No.: 09/915,471

(22) Filed: Jul. 26, 2001

(65) Prior Publication Data

US 2002/0078484 A1 Jun. 27, 2002

Related U.S. Application Data

(60) Provisional application No. 60/257,719, filed on Dec. 22, 2000.

(51) Int. Cl.[7] ..... A41D 13/00
(52) U.S. Cl. ..... 2/465; 2/DIG. 3
(58) Field of Search ..... 2/227, 69, 46, 2/455, 79, 92, 44, 228, 238, 51, 456, 267, 208, 66, 22, 91, 465–467, 908, DIG. 3

(56) References Cited

U.S. PATENT DOCUMENTS

| | | | | | |
|---|---|---|---|---|---|
| 1,080,985 | A | * | 12/1913 | Leap | 2/465 |
| 3,895,396 | A | * | 7/1975 | Amarantos | 2/455 |
| 4,637,074 | A | * | 1/1987 | Taheri | 2/DIG. 3 |
| 5,500,952 | A | * | 3/1996 | Keyes | 2/455 |
| 6,032,299 | A | * | 3/2000 | Welsh | 2/456 |

* cited by examiner

*Primary Examiner*—Tejash Patel
(74) *Attorney, Agent, or Firm*—Valerie K. Friedrich

(57) ABSTRACT

A hip protecting device for minimizing risk of hip breakage upon a fall having a belt from which one or two gas inflatable pockets are suspended substantially over the hip joint or hip joints of a wearer. The hip protecting device further has a means for detecting rate and degree of attitudinal changes of the wearer, a microprocessor and inflation means. Upon detection of both a rate and degree of change in attitude of the wearer outside certain preprogrammed limits, the microprocessor sends a signal to the inflation means thereby causing the pocket or pockets to inflate and cushion the hips from the fall.

14 Claims, 3 Drawing Sheets

HIP PROTECTOR

This application claims the benefit of provisional application Ser. No. 60/257,719, filed Dec. 22, 2000.

FIELD OF THE INVENTION

This invention relates to a compact, automatically-deployable protective device which provides a cushioning effect on the hips upon a fall by the wearer of the device.

BACKGROUND OF THE INVENTION

Hip fracture is a costly and painful problem for individuals of any age. Hip fracture generally occurs when an individual falls and lands on a hip or an area of the body proximate to a hip. Several factors, therefore, make hip fractures a particular hazard for the elderly. First, as a person ages, he or she often has an increase in muscular degeneration and visual impairment and decreases in gait and balance, thereby making trips and falls more likely. Second, as a person ages, he or she often suffers from a decrease in bone density making fractures more likely from even relatively low impact incidents. Finally, elderly individuals sustaining hip fracture injuries are more likely than their younger counterparts to suffer certain other medical complications, such as pneumonia. The affects of hip fracture on an elderly individual can be quite severe. Half of all elderly victims of hip fracture are unable to ever return to their previous life and activity level, often necessitating a move into an assisted living or nursing care facility. Societal impacts of hip fracture are also great and are likely to increase as the population ages. It has been estimated that there are over 250,000 hip fractures in the United States with an estimated Medicare cost of about $2.9 billion. It is estimated that the number of annual hip fractures could rise to 500,000 by the year 2040, due to the increasing population of elderly persons.

One method employed to prevent hip fractures is the use of hip protecting devices which cushion the hips on impact. A number of clinical studies have shown considerable protection against hip fracture upon fall with a hip protection device. See, e.g., Effect of External Hip Protectors on Hip Fractures, J.B. Lauritzen et al, Lancet, 341:11–13 (1993). One of the major problems with currently available hip protectors is compliance, or the willingness of individuals to consistently wear the protectors. Examination of available devices clarifies the compliance problem as the devices tend to be bulky, uncomfortable and lend an unattractive appearance to the wearer. A know device is made of two rigid plastic concave pieces which are placed in pockets in specially constructed boxer-style underwear such that the plastic pieces ride over and cup the hip joints. Further, another known device consists of a specially constructed boxer-style underwear having compressible pads integrally associated with the underwear and positioned so as to ride over the hip joints. The protecting features, the rigid plastic pieces or the compressible pads, are in place and "activated" at all times during use of the devices. That is, the protecting features are present even when the wearer is not in danger of a fall but rather may be sitting or walking safely. Consequently, the extra width caused by the rigid plastic pieces or compressible pads is always present giving an unattractive appearance and tending to decrease compliance. Furthermore, the constant presence of the compressible pads and especially the rigid plastic pieces is uncomfortable especially if worn under any but the loosest of clothing. Such discomfort also decreases compliance.

SUMMARY OF THE INVENTION

It is an object of the present invention to improve compliance by providing an inconspicuous, lightweight hip protecting device which only deploys upon automatic detection of a fall. The device of the present invention provides deployable hip cushions which are suspended above the hip joints using a belt-like attachment. The cushions of the present device are deployed only when a fall is sustained or appears to be imminent. The cushions are deployed automatically, not requiring the activation of the wearer or other party. The present device may be worn with an individuals own underwear and when not deployed provides negligible bulk to the hips of the wearer.

DETAILED DESCRIPTION OF THE INVENTION

Figure 1:
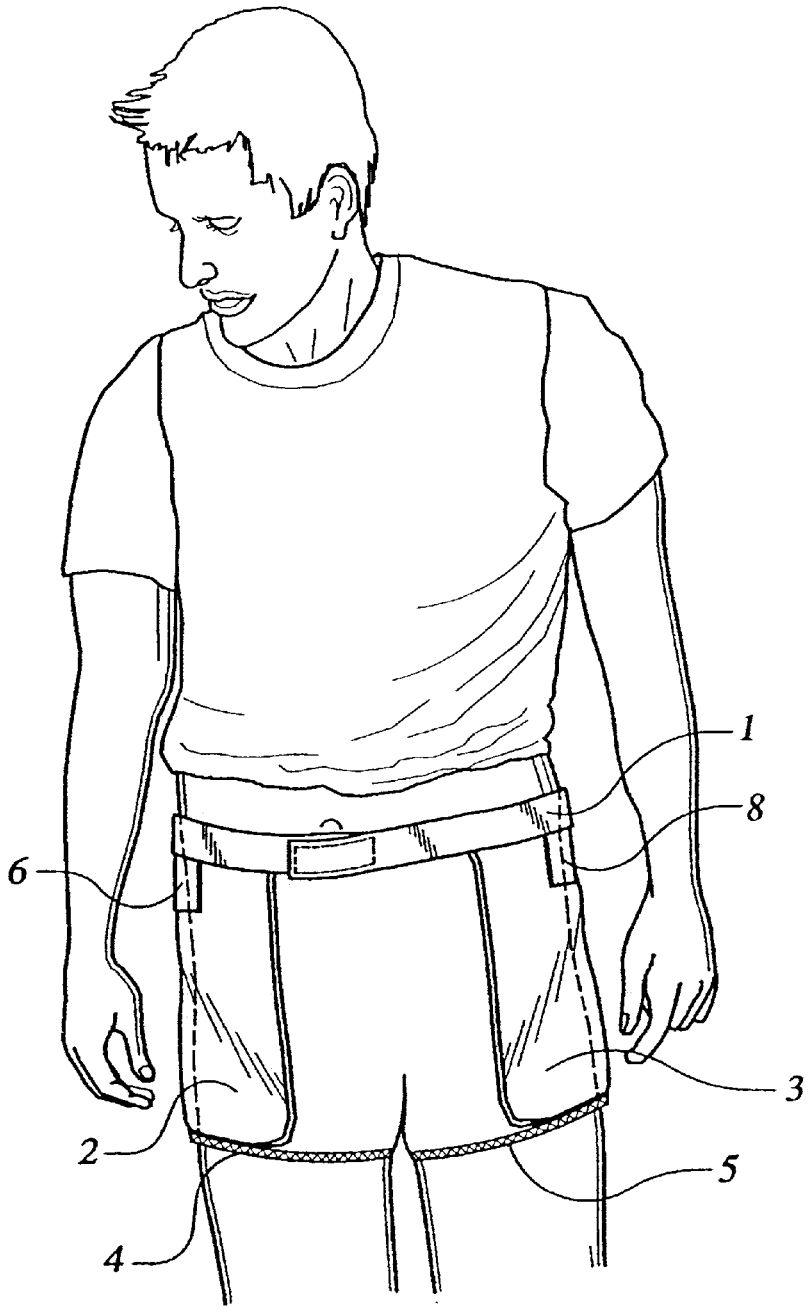
FIG. 1 is a perspective view of the device of the present invention in its undeployed state as worn, with the dashed lines indicating the outline of the body of a wearer.

Referring first to FIG. 1, the device of the present invention is comprised of a belt 1 from which two pockets, a right pocket 2 and a left pocket 3 are suspended such that right pocket 2 lies substantially over the right hip joint of the wearer and left pocket 3 lies substantially over the left hip joint of the wearer. Each of right pocket 2 and left pocket 3 are enclosed forms so as to hold within each of right pocket 2 and left pocket 3 a volume of gas when the present device is activated. Retaining straps 4 and 5 may optionally be attached to the lower portions of right pocket 2 and left pocket 3, respectively. Retaining straps 4 and 5, if used, wrap around the right and left thighs, respectively, of the wearer so as to maintain the position of right pocket 2 and left pocket 3. Retaining straps 4 and 5 may be comprised of an elastic or non-elastic material. Belt 1 may be a relatively straight piece of material having two ends with any of a number of available buckling or attaching mechanisms, such as buckles, snaps, or hook and eye strips, so that the belt may be fit around a range of girths. Alternatively belt 1 may be a unitary piece having some elasticity so as to fit around a range of girths. It will be understood that the present invention may be made with a number of different belt sizes so as to fit a wide range of girths.

Figure 3:
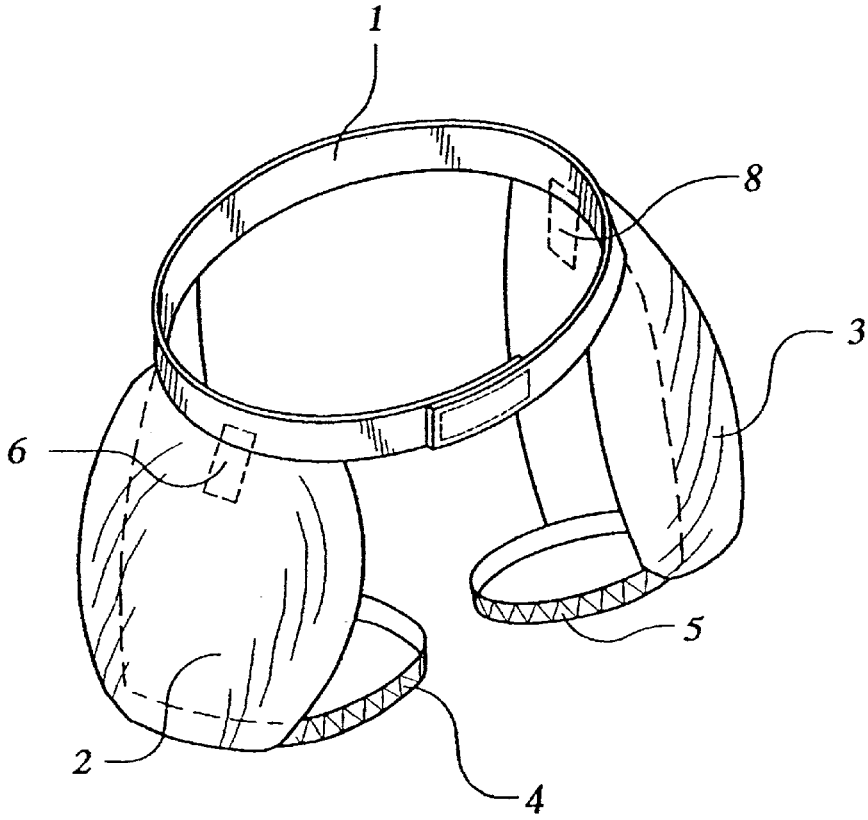
FIG. 3 is a partial view of the device of the present invention showing the right side of the device in its deployed state.

Right pocket 2 and left pocket 3 are substantially rectangular in shape and may be made of any of a number of substantially gas impermeable materials, such as nylon or kevlar. The material of construction of right pocket 2 and left pocket 3 should be chosen so as to contain a deployment gas for the duration of a fall and impact. It will be understood that in an alternative embodiment, right pocket 2 and left pocket 3 may not be attached directly to belt 1 but rather may be placed within appropriately sized and placed pouches which are directly attached to belt 1. In the preferred embodiment, right and left pockets 2 and 3 are directly attached to belt 1. In an alternative embodiment, right pocket 2 and left pocket 3 may be attached to belt 1 by a means which permit slight lateral adjustments, such as with use of hook and eye strips. Right pocket 2 and left pocket 3 are sized to accept a volume of gas upon deployment of the present device. Consequently, in the undeployed state, right pocket 2 and left pocket 3 may have pleats allowing the excess material in the undeployed state to lie flat against the body of the wearer. In the preferred embodiment, right pocket 2 and left pocket 3 will be shaped so as to cradle the hip area of the wearer upon deployment. FIG. 3 illustrates this cradling shape.

Figure 2:
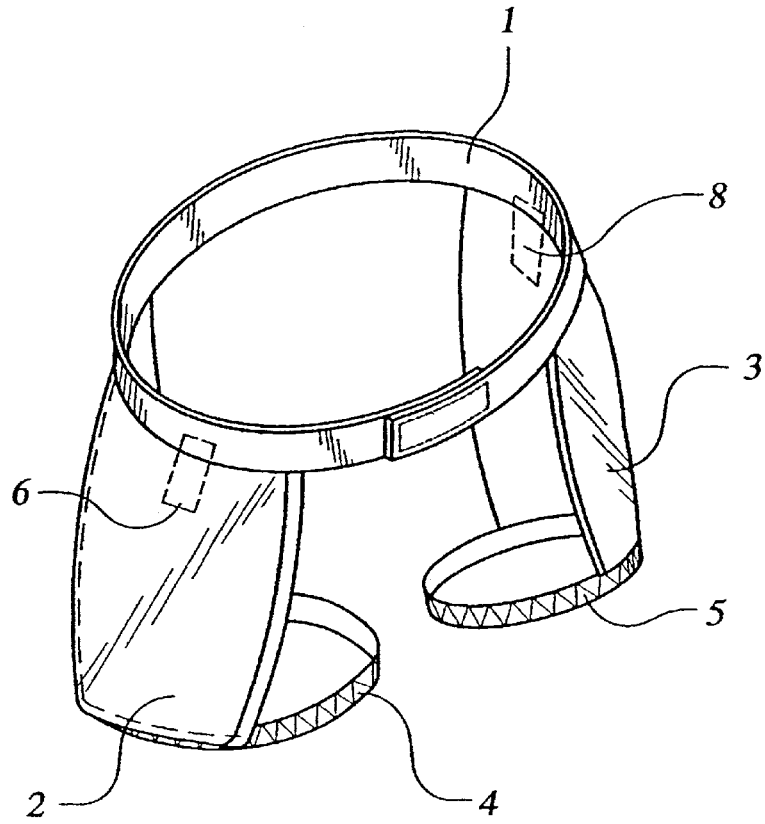
FIG. 2 is a partial view of the device of the present invention showing the right side of the device in its undeployed state.

Referring now to FIG. 3, it is shown how right pocket 2 expands upon deployment thereby providing a gas filled cushion against the impact of the hip joint whereas FIG. 2 shows right pocket 2 in its undeployed, uninflated state, lying flat against the hip of the wearer. Right pocket 2 is inflated through gas activation part 6 which connects into right pocket 2 through an opening 7. Gas activation part 6 provides the gas used to inflate right pocket 2 upon deployment. Gas activation part 6 may be either a small compressed gas cylinder or, as in the preferred embodiment, a chemical reaction chamber in which a gas-producing chemical reaction occurs. Inflation of left pocket 3 is accomplished by activation of a gas activation part 8 (not shown in FIG. 3), identical to gas activation part 6 but connecting with left pocket 3 through an opening 9 (not shown in FIG. 3).

Figure 4:
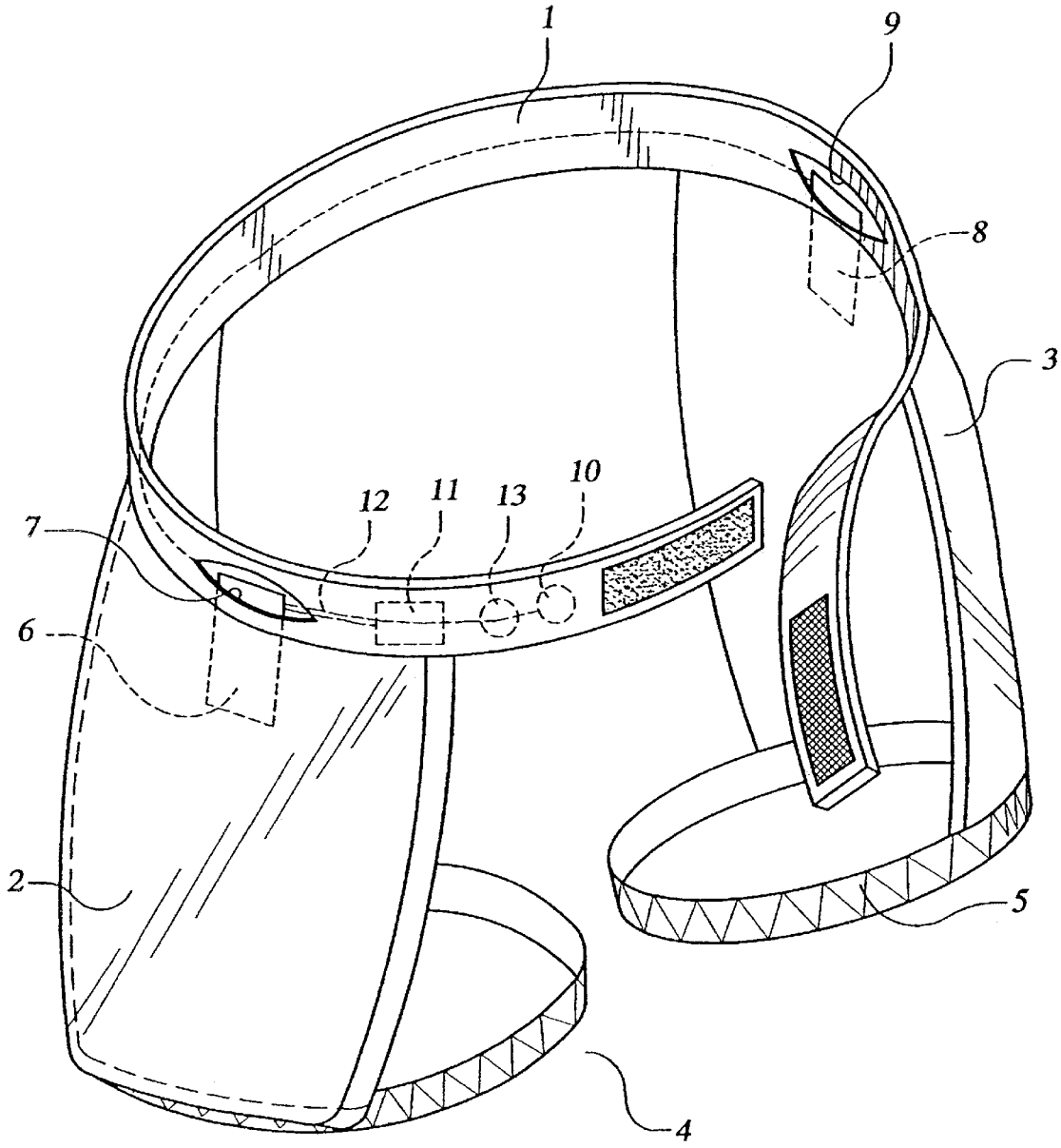
FIG. 4 is a perspective transparent view of the device of the present invention, in its undeployed state, illustrating the wiring of the automatic deployment mechanism.

Referring now to FIG. 4, the deployment mechanism is discussed. An omnidirectional sensor 10 is electrically connected to a battery 11, microprocessing unit 13 and to each of gas activation parts 6 and 8. Electricity conducting wires 12 are shown providing such electrical connections. Sensor 10 can be any of a number of available sensors, such as an appropriate number of appropriate dimension accelerometers, e.g., a single triaxial accelerometer, two biaxial accelerometers or three uniaxial accelerometers. Other orientational sensors which could be used include a three axis electronic compass. Sensor 10 may continuously, intermittently or upon command send an electronic signal indicative of the rate and degree of any attitudinal change to a microprocessing unit 13 through wires 12.

Microprocessing unit 13 contains preprogrammed limits for both the rate and degree of attitudinal change. When both the rate and degree of an attitudinal change fall outside such preprogrammed limits, thereby indicating a fall rather than a controlled reclining motion, microprocessing unit 13 sends an electronic signal to gas activation parts 6 and 8 so as to initiate inflation of right pocket 2 and left pocket 3. Each of sensor 10, battery 11, and microprocessing unit 13 may be located anywhere within the present device but are most preferably attached to or within belt 1. Sensor 10, battery 11 and microprocessing unit 13 may be located at any position on belt 1. As shown in FIG. 4, sensor 10, battery 11, and microprocessing unit 13 are located near a right end of belt 1. It will be understood that sensor 10, battery 11 and microprocessing unit 13 may some or all be contained within a single housing. In a second preferred embodiment, sensor 10 and microprocessor 13 are located at about the midpoint of belt 1 so that it is positioned at about the middle of a wearer's back. In such second preferred embodiment, each of wires 12 connecting microprocessor 13 to each of gas activation devices 6 and 8 are equidistant providing the minimum delay time in which both right pocket 2 and left pocket 3 can be simultaneously deployed. As shown in FIG. 4, sensor 10 and nicroprocessing unit 13 are always in electrical connection with battery 11 and therefore, the sensor and microprocessor are always in an "on" position. It will be understood that an on/off switch may be placed between sensor 10 and battery 11 allowing sensor 10 to be turned off when the present device is not worn and thereby preserving the life of battery 11. It will be further understood that a status indicator may also be included within the electrical connection to indicate if the sensor 10 is powered. Such status indicators and the method of connecting them within an electrical circuit are well known in the art Similarly, a low battery power indicator may also be included within the electrical circuit and such indicators as well as the method of connecting them within an electrical circuit are well known in the art.

In its preferred embodiment, the present device utilizes a chemical reaction activated within gas activation devices 6 and 8 to rapidly produce a gas upon receipt of a signal from sensor 10. Although a number of chemical reactions produce a gas, in the preferred embodiment, the chemical reaction between a combination of sodium azide, potassium nitrate and silicon dioxide is activated by the heat generated with a Chromaloy bridgewire having a 1 ohm resistance. Because reactions producing a gas, such as that described herein, generally generate a great amount of heat, it will be understood that gas activation devices 6 and 8 should be constructed of stainless steel or other material that can withstand the heat of the chemical reaction used to generate the gas. Because such reactions generate substantial amounts of heat, a thermally insulating material, such as kevlar, is used between the body of the wearer and gas activation parts 6 and 8. Although the preferred chemical reaction is described above, other gas producing reactions could be used in the present invention. For example, reactions utilizing boron, zirconium or xenon as a fuel and potassium perchlorate or fluorine as an oxidizer could be used to generating a gas to inflate the right pocket 2 and left pocket 3.

It will be understood that several factors must be considered in determining the type and amounts of reactants used and the amount of gas generated. For example, the reaction must occur sufficiently rapidly to provide inflation of the right and left pockets 2 and 3 before the impact of a fall occurs. Furthermore, the height and weight of the wearer must be considered as such information determines the pressure of impact and the amount of pressure which must be present in right and left pockets 2 and 3 to cushion the impact without causing significant rebound of the wearer.

In an alternative embodiment, gas is provided by use of compressed gas cylinders rather than through a gas producing reaction. In such embodiment, gas activation parts 6 and 8 are appropriately sized compressed gas cylinders containing any appropriate, preferably inert gas, such as nitrogen.

The present invention is more fully illustrated by reference to the following examples:

EXAMPLE 1

An individual weighing 280 pounds and having a hip height of 50 inches would have an impact energy on a sideways fall of 14,000 in-lb. Individuals weighing less or having a shorter hip height would incur less impact energy on their hip in a sideways fall. For a right and/or left pocket having a size of 6 inches long by 8 inches wide by 2 inches deep, the total surface area is 48 square inches. To equal the 14,000 in-lb. impact energy, the pocket must be inflated to a gas pressure of 146 psi. However, in the preferred embodiment, the gas pressure is raised above this amount so as to prevent the hip of the wearer from traveling through the 2 inch depth of the pocket. For example, a gas pressure of 300 psi may be used in the pockets to cushion the impact more completely. To achieve a total pressure of 312.6psi, a total of 6 mg. of the reaction mixture according to the equation:

$$2.5\ NaN_{3+0.5}\ KNO_{3+1.5}\ SiO_{2\Delta 4}N_{2+1.25}\ Na_2SiO_{3+0.25}\ K_2SiO_3$$

should be used for each pocket. Reaction mixtures which produce a gas upon activation, such as the reaction mixture shown on the left side of the above chemical equation are referred to as pyrotechnic compositions.

EXAMPLE 2

Another issue which must be addressed is the timing of activation of a pocket upon detection of a fall. For an individual with a hip height of 35 inches and considering an uninterrupted sideways fall from a standing position, the hip will impact the floor at 506 milliseconds from commencement of the fall. For an individual with a hip height of 50 inches, the time to impact increases to 605 milliseconds. Therefore, the pockets should inflate within 500 milliseconds from conmencement of a fall. It will be understood that several firing mechanisms, such as a Chromaloy bridgewire, may be used to activate the reaction within the 500 millisecond time.

We claim:

1. A hip protecting device for inflating a pocket over a hip joint of a wearer of the device upon a fall comprising:

a belt;

a substantially gas impermeable first pocket fixedly suspended substantially over a first hip joint of said wearer from said belt;

a substantially gas impermeable second pocket fixedly suspended substantially over a second hip joint of said wearer from said belt;

a first inflation means, connected to said first pocket, for inflating said first pocket with a gas;

a second inflation means, connected to said second pocket, for inflating said second pocket with a gas;

sensor means, for detecting the rate and degree of attitudinal changes of said wearer and for generating electrical output indicative of said rate and degree attitudinal changes;

microprocessor means electrically connected to said sensor means and to said first and second inflation means and having preset ranges for rate and degree of attitudinal changes, to compare and perform an analysis of said electrical output and for activating said inflation means to inflate said first and second pockets when said analysis indicates a rate and degree of attitudinal change outside said preset ranges;

said first inflation means comprises at least one chamber containing a pyrotechnic composition, and means for activating said pyrotechnic composition, said means for activating said pyrotechnic composition electrically connected to said microprocessor means and said second inflation means comprises at least one chamber containing a pyrotechnic composition, and means for activating said pyrotechnic composition, said means for activating said pyrotechnic composition electrically connected to said microprocessor means; and a battery electrically connected to said sensor means and to said microprocessor means.

2. The hip protecting device of claim 1, wherein said sensor means is one or more accelerometers.

3. The hip protecting device of claim 1, wherein said sensor means is a three axis electronic compass.

4. A hip protecting device for inflating a pocket over a hip joint of a wearer of the device upon a fall comprising:

a belt;

a substantially gas impermeable first pocket fixedly suspended substantially over a first hip joint of said wearer from said belt;

a substantially gas impermeable second pocket fixedly suspended substantially over a second hip joint of said wearer from said belt;

a first inflation means, connected to said first pocket, for inflating said first pocket with a gas;

a second inflation means, connected to said second pocket, for inflating said second pocket with a gas;

sensor means, for detecting the rate and degree of attitudinal changes of said wearer and for generating electrical output indicative of said rate and degree attitudinal changes;

microprocessor means electrically connected to said sensor means and to said first and second inflation means and having preset ranges for rate and degree of attitudinal changes, to compare and perform an analysis of said electrical output and for activating said inflation means to inflate said first and second pockets when said analysis indicates a rate and degree of attitudinal change outside said preset ranges;

said first inflation means comprises at least one chamber containing a pressurized gas, having an electrically operated release valve connected to said first pocket, with said release valve being electrically connected to said microprocessor means and wherein said second inflation means comprises at least one chamber containing a pressurized gas, having an electrically operated release valve connected to said second pocket, with said release valve being electrically connected to said microprocessor means; and a battery electrically connected to said sensor means and to said microprocessor means.

5. The hip protecting device of claim 4, wherein said sensor means is one or more accelerometers.

6. The hip protecting device of claim 4, wherein said sensor means is a three axis electronic compass.

7. A hip protecting device for inflating a pocket over a hip joint of a wearer of the device upon a fall comprising:

a belt;

a substantially gas impermeable first pocket fixedly suspended below said belt and lying substantially over a first hip joint of said wearer from said belt;

a first inflation means, connected to said first pocket, for inflating said first pocket with a gas;

sensor means, for detecting the rate and degree of attitudinal changes of said wearer and for generating electrical output indicative of said rate and degree attitudinal changes;

microprocessor means electrically connected to said sensor means and having preset ranges for rate and degree of attitudinal changes, to compare and perform an analysis of said electrical output and for activating said inflation means to inflate said first pocket when said analysis indicates a rate and degree of attitudinal change outside said preset ranges; and a battery electrically connected to said sensor means and to said microprocessor means;

a substantially gas impermeable second pocket fixedly suspended substantially over a second hip joint of said wearer from said belt; and a second inflation means, connected to said second pocket, for inflating said second pocket with a gas.

8. The hip protecting device of claim 7 wherein said sensor means comprises a means for sensing said angular orientation of said wearer with respect to each of three mutually perpendicular axes.

9. The hip protecting device of claim 7 wherein said sensor means is a three axis electronic compass.

10. The hip protecting device of claim 7 wherein said sensor means is one or more accelerometers.

11. The hip protecting device of claim 7, wherein said sensor means is a three axis electronic compass.

12. The hip protecting device of claim 7, wherein said sensor means is one or more accelerometers.

13. A hip protecting device for inflating a pocket over a hip joint of a wearer of the device upon a fall comprising:

a belt;

a substantially gas impermeable first pocket fixedly suspended below said belt and lying substantially over a first hip joint of said wearer from said belt;

sensor means, for detecting the rate and degree of attitudinal changes of said wearer and for generating electrical output indicative of said rate and degree attitudinal changes;

microprocessor means electrically connected to said sensor means and having preset ranges for rate and degree of attitudinal changes, to compare and perform an analysis of said electrical output and for activating said inflation means to inflate said first pocket when said analysis indicates a rate and degree of attitudinal change outside said preset ranges;

a first inflation means, connected to said first pocket, for inflating said first pocket with a gas, wherein said first inflation means comprises:

at least one chamber containing an inflammable pyrotechnic composition; and means for activating said pyrotechnic composition, said means for activating said pyrotechnic composition electrically connected to said microprocessor means; and a battery electrically connected to said sensor means and to said microprocessor means.

14. The hip protector of claim 13 wherein said first pocket is inflated by said first inflation means within 500 milliseconds of activation of pyrotechnic composition.

* * * * *